US009119448B1

(12) United States Patent
Hirshberg

(10) Patent No.: US 9,119,448 B1
(45) Date of Patent: Sep. 1, 2015

(54) CARRYING BAGS AND BACKPACKS WITH EXPANDABLE RETAINER TO CONTAIN AND SECURELY CARRY LARGE OBJECTS

(75) Inventor: Jonathan Scott Hirshberg, Manhattan Beach, CA (US)

(73) Assignee: JR286 Technologies, Inc., Los Angeles, CA (US)

( * ) Notice: Subject to any disclaimer, the term of this patent is extended or adjusted under 35 U.S.C. 154(b) by 2607 days.

(21) Appl. No.: 11/243,371

(22) Filed: Oct. 3, 2005

(51) Int. Cl.

| | |
|---|---|
| ***A45F 4/00*** | (2006.01) |
| ***A45C 15/00*** | (2006.01) |
| ***A45C 7/00*** | (2006.01) |
| *A45F 3/04* | (2006.01) |

(52) U.S. Cl.
CPC *A45C 7/0077* (2013.01); *A45F 3/04* (2013.01)

(58) Field of Classification Search
CPC ..... A45C 3/00; A45C 5/06; A45C 7/0077; A45C 7/0063; A45C 9/00; A45F 3/04; A45F 3/14; A45F 3/02; A01K 97/10
USPC ..... 224/581, 582, 583, 652, 645, 650, 683, 224/656; 190/108
See application file for complete search history.

(56) References Cited

U.S. PATENT DOCUMENTS

| | | | | | |
|---|---|---|---|---|---|
| 1,810,813 | A | * | 6/1931 | Bertini | 383/38 |
| 2,682,290 | A | * | 6/1954 | Ditlea | 383/121 |
| 3,122,225 | A | * | 2/1964 | Ward | 190/108 |
| 4,018,369 | A | * | 4/1977 | Jaeger | 224/582 |
| 4,236,615 | A | * | 12/1980 | Ginat | 190/111 |
| 4,334,601 | A | * | 6/1982 | Davis | 224/148.3 |
| 4,515,300 | A | * | 5/1985 | Cohen | 224/153 |
| 4,805,748 | A | * | 2/1989 | Gerch | 190/103 |
| 4,974,709 | A | * | 12/1990 | Furlow et al. | 190/102 |
| 5,158,220 | A | * | 10/1992 | Glass | 224/657 |
| 5,472,280 | A | * | 12/1995 | Rittmaster | 383/6 |
| 5,490,619 | A | * | 2/1996 | Boyar | 224/153 |
| 5,497,919 | A | * | 3/1996 | Klinger | 224/416 |
| 5,692,660 | A | * | 12/1997 | Stewart | 224/581 |
| 5,779,121 | A | | 7/1998 | Capwell | |
| D398,776 | S | | 9/1998 | Fawcett | |
| 5,890,809 | A | | 4/1999 | Nelson | |
| D410,329 | S | | 6/1999 | Wyatt | |
| 6,092,702 | A | * | 7/2000 | Cassidy, IV | 224/153 |
| 6,109,402 | A | * | 8/2000 | Godshaw et al. | 190/108 |
| D440,040 | S | | 4/2001 | Cantasano | |

(Continued)

FOREIGN PATENT DOCUMENTS

WO PCT/US97/22424 12/1997

*Primary Examiner* — Justin Larson
*Assistant Examiner* — Peter Helvey
(74) *Attorney, Agent, or Firm* — Thomas I. Rozsa

(57) ABSTRACT

The present invention is a carrying bag such as a gym bag or backpack which includes at least a pocket formed on the outside of the bag or backpack which contains a nylon mesh or other expansion type retainer sewn into the interior of the pocket which is closed by closing means such as a zipper. When the pocket is opened, the expansion retainer means can be unfolded and a large object such as a basketball, football, or objects such as wet clothes can be placed in the expansion retainer. The object within the expansion retainer is securely retained by a drawstring with a locking retainer to be sure the expansion retainer is closed and thereafter a clip or D-ring connects the top of the expansion retainer to a portion of the gym bag or backpack so that it is securely retained to assure that the objects will not fall out and will hang off the side of the gym bag or backpack so as not to put a strain on the carrier's back.

14 Claims, 11 Drawing Sheets

(56) References Cited

U.S. PATENT DOCUMENTS

| | | | | |
|---|---|---|---|---|
| 6,237,764 | B1 * | 5/2001 | Kastelic | 206/315.1 |
| 6,257,406 | B1 | 7/2001 | Garino | |
| 6,286,674 | B1 | 9/2001 | Richard | |
| 6,328,146 | B1 * | 12/2001 | Siwak | 190/109 |
| 6,581,736 | B1 * | 6/2003 | Scicluna | 190/109 |
| 6,612,472 | B1 | 9/2003 | Zakarin | |
| 6,742,636 | B2 * | 6/2004 | Godshaw | 190/111 |
| 7,600,620 | B2 * | 10/2009 | Hammond | 190/108 |
| 2002/0113102 | A1 | 8/2002 | Klamm | |
| 2004/0149793 | A1 | 8/2004 | Theodore | |
| 2004/0195286 | A1 | 10/2004 | Greenhalgh | |

* cited by examiner

CARRYING BAGS AND BACKPACKS WITH EXPANDABLE RETAINER TO CONTAIN AND SECURELY CARRY LARGE OBJECTS

BACKGROUND OF THE INVENTION

1. Field of the Invention

The present invention relates to the field of carrying bags such as gym bags and other objects used to carry sports items such as backpacks. In particular, the present invention relates to improvements in such carrying bags which enable a person to carry objects which are too large to fit within the carrying bag or to carry large objects in a manner which will not take up a lot of room within the carrying bag.

2. Description of the Prior Art

In general, the concept of having an expandable pocket to retain objects outside of the carrying bag or backpack has been known in the prior art. The following 13 patents and published patent applications are relevant to the field of the present invention.

1. U.S. Pat. No. 5,779,121 issued to Capwell on Jul. 14, 1998 for "Pocket Closure And Compression Strap For A Pack" (hereafter the "Capwell Patent");

2. U.S. Pat. No. Des. 398,776 issued to Fawcett on Sep. 29, 1998 for "Pack With Pocket" (hereafter the "Fawcett Patent");

3. U.S. Pat. No. 5,890,809 issued to Nelson on Apr. 6, 1999 for "Carrying Bag With Deployable Bottle Pouch" (hereafter the "Nelson Patent");

4. U.S. Pat. No. D440,040 S issued to Cantasano on Apr. 10, 2001 for "Jacquard Woven Golf Ditty Bag" (hereafter the "Cantasano Patent");

5. U.S. Pat. No. Des. 410,329 issued to Wyatt on Jun. 1, 1999 for "Combined Rucksack And Net Bag" (hereafter the "Wyatt Patent");

6. U.S. Pat. No. 6,257,406 B1 issued to Garino on Jul. 10, 2001 for "Detachable Basketball Hanger" (hereafter the "Garino Patent");

7. U.S. Pat. No. 6,286,674 B1 issued to Richard on Sep. 11, 2001 for "Carrying Bag With Ball Container" (hereafter the "Richard Patent");

8. U.S. Pat. No. 6,328,146 B1 issued to Siwak on Dec. 11, 2001 for "Baggage With Retractable Beverage Container Pocket" (hereafter the "Siwak Patent");

9. United States Patent Application Publication No. US 2002/0113102 A1 to Klamm on Aug. 22, 2002 for "Backpack That Is Foldable Into A Bag" (hereafter the "Klamm Patent Publication");

10. U.S. Pat. No. 6,612,472 B1 issued to Zakarin on Sep. 2, 2003 for "Carrying Bags And Storage Compartments For Headwear" (hereafter the "Zakarin Patent");

11. United States Patent Application Publication No. US 2004/0149793 A1 to Theodore on Aug. 5, 2004 for "Triathlonbag II" (hereafter the "Theodore Patent Publication");

12. United States Patent Application Publication No. US 2004/0195286 A1 to Greenhalgh on Oct. 7, 2004 for "Carrier" (hereafter the "Greenhalgh Patent Publication");

13. PCT Application No. PCT/US97/22424 filed on Dec. 3, 1997 for "Sports Bag" (hereafter the "'22424 PCT Application").

The Capwell Patent discloses the general concept of an expandable pocket attached to the back of a backpack including a pocket panel 34 which may have side or bottom gussets (not shown) forming an expanded pocket. The pocket is formed onto the backpack and does not appear to be large enough to carry large objects such as a basketball or a soccer ball. Carrying object in this way will put a strain on the wearer's back.

The Fawcett Patent is a design patent which shows the concept of a pack with a pocket made of mesh fabric. The mesh pocket is mostly open and it is easy for objects to fall out if the pack is turned upside down or jostled.

The Nelson Patent discloses a bag referred to generally by the reference numeral 10 which is provided with a bottle pouch 12 for supporting and carrying a water bottle 14. The bottle pouch 12 is designed for movement between a stored position (FIGS. 1 and 6) contained and concealed within a pocket 16 of the bag, and a deployed position (FIGS. 2 and 4) exposed to the exterior of the bag for use and carrying the water bottle 14. The pouch is not designed to be completely closed so it is easy for the water bottle to fall out.

The Cantasano Patent is also a design patent for a golf ditty bag.

The Wyatt Patent discloses a combined rucksack and net bag which has a mesh net back which is attached at one end of the rucksack. The top opening of the net can be closed with a drawstring but will still have an opening through which objects can fall out.

The Garino Patent discloses basketball hanger which has a mesh bag for retaining a basketball on a physical object.

The Richard Patent discloses a carrying bag with a ball container. The primary container backpack has a zippered attachment member (see FIG. 4 to see the mating zippers), which zippered attachment member is a separate ball carrying container which is large enough to hold a basketball and has a mesh understructure in a top closing portion so that the top of the ball is closed and zippered shut. The entire weight of the ball is on the backpack which can create a strain on the back of the person carrying the backpack.

The Siwak Patent discloses a baggage with mesh attachment that is configured to support a beverage container on the exterior of the baggage. The pocket is constructed of a mesh material and has an elastic strap along an upper edge that allows the pocket to expand to support various size containers, such as a bottled water. When not in use, the pocket can be held collapsed against or inside the piece of baggage by a closure mechanism such as a zipper. The mesh pocket cannot be completely closed so it is easy for objects retained therein to fall out.

The Klamm Patent Publication is a published patent application which discloses a compressible storage bag that is included in the pouch of a backpack (see FIG. 4 for best illustration) and the pouch can be removed and the backpack folded into the pouch.

The Zakarin Patent discloses a backpack that includes a rear compartment formed in part from an expandable material for receiving oversized items such as basketballs, soccer balls, footballs and the like. As with the Richard Patent, the entire weight of the ball is on the backpack which can create a strain on the back of the person carrying the backpack.

The Theodore Patent Publication is a published patent application which discloses a collapsible bag comprised of a pouch 21 of flexible water resistant material, such as nylon, and a mesh cylinder 20. The mesh cylinder 20 is connected to the open end of the pouch 21 and may be closed with a draw string as depicted in FIG. 5.

The Greenhalgh Patent is a published application which discloses is a backpack which is used by motorcyclists. A bag 11 has a main compartment 22 and a lower compartment 25 adapted to receive the helmet 26 inside it so that the carrier 10 can be freestanding when placed on the ground.

The PCT Application discloses a sport bag 10 wherein a sports ball compartment 50 for retaining a sports ball is coupled to an outer surface of a primary compartment 20. Secondary storage compartments 32, 34 and 44 such as first and second cleat pockets 32 and 34 and a contaminated article pocket 44 are lined with inner sleeves 36. A drawstring closure 66 and a protective flap 70 combine to protect each of the primary compartments 20 and the first and second cleat pockets 32 and 34 while permitting a ventilating communication between the contents of each compartment 20, 32 and 34 and the environment. As with the Richard and Zakarin Patents, the entire weight of the ball is on the backpack which can create a strain on the back of the person carrying the backpack.

There is a significant need for an improved expandable retainer incorporated into a gym bag or backpack which can securely carry large objects such as a basketball or soccer ball in a way that the expandable but is not formed into the backpack to put a strain on the wearer's back when the object is carried within the retainer.

SUMMARY OF THE INVENTION

The present invention is a carrying bag such as a gym bag or backpack which includes at least a pocket formed on the outside of the bag or backpack which contains a nylon mesh or other expansion type retainer sewn into the interior of the pocket which is closed by closing means such as a zipper. When the pocket is opened, the expansion retainer means can be unfolded and a large object such as a basketball, football, or objects such as wet clothes can be placed in the expansion retainer. The object within the expansion retainer is securely retained by a drawstring with a locking retainer to be sure the expansion retainer is closed and thereafter a clip or D-ring connects the top of the expansion retainer to a portion of the gym bag or backpack so that it is securely retained to assure that the objects will not fall out and will hang off the side of the gym bag or backpack so as not to put a strain on the carrier's back.

It has been discovered, according to the present invention, that if a nylon mesh ball expansion retainer is tucked away into a zippered outer pocket on a gym bag or backpack when not in use and is removed and unfolded when the zippered pocket is opened, then the expansion retainer will hang off the side of the gym bag or backpack to receive large objects or objects such as a basketball or soccer ball, or wet clothes which a person does not want to put into the gym bag or backpack.

It has further been discovered, according to the present invention, that if the expansion retainer has an open top at the location remote from where it is attached to the gym bag or backpack and is closed with a drawstring having a locking retainer, the retained objects will not fall out and further if the expansion retainer includes a first clip mating member when can be attached to a second clip mating member on the gym bag or backpack, then in addition to assuring that the retained objects will not fall out of the expansion retainer, the expansion retainer with the retained object will hang off the side of the gym back or off the back of the backpack so as not put but a strain on the back of the person carrying the gym bag or backpack.

It has additionally been discovered that the preferred form of the expansion retainer is nylon mesh since it is lightweight, has breathing openings and can conform to the shape of the object being carried within. It also allows wet clothes retained therein to dry out more rapidly.

It is therefore an object of the present invention to provide a nylon mesh ball expansion retainer which is tucked away into a zippered outer pocket on a gym bag or backpack when not in use and is removed and unfolded when the zippered pocket is opened, so that the expansion retainer will hang off the side of the gym bag or backpack to receive large objects or objects such as a basketball or soccer ball, or wet clothes which a person does not want to put into the gym bag or backpack.

It is a further object of the present invention to provide an expansion retainer which has an open top at the location remote from where it is attached to the gym bag or backpack and is closed with a drawstring having a locking retainer so that the retained objects will not fall out and further to provide the expansion retainer with a first clip mating member which can be attached to a second clip mating member on the gym bag or backpack so that in addition to assuring that the retained objects will not fall out of the expansion retainer, the expansion retainer with the retained object will also hang off the side of the gym back or off the back of the backpack so as not put but a strain on the back of the person carrying the gym bag or backpack.

It is an additional object of the present invention to provide an expansion retainer made of nylon mesh because it is lightweight, has breathing openings and can conform to the shape of the object being carried within. It also allows wet clothes retained therein to dry out more rapidly.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
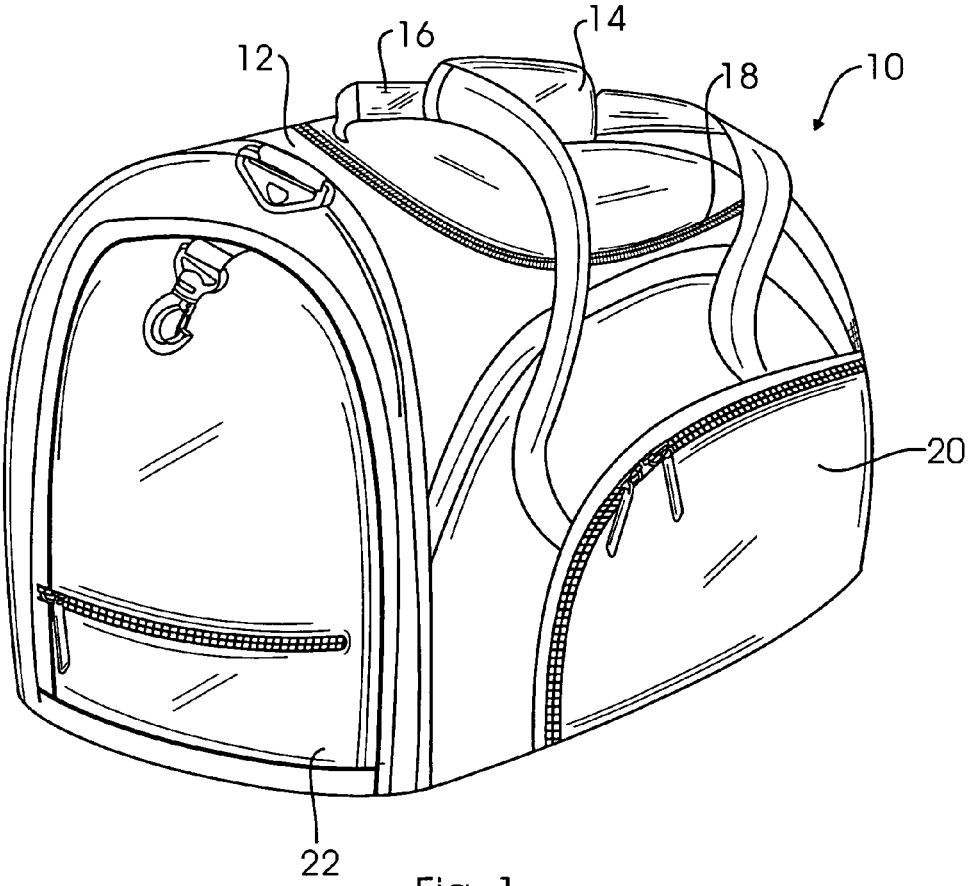
FIG. 1 is a perspective view of a gym bag incorporating the present invention expansion retainer within a side pocket which is shown in the closed condition.
Figure 2:
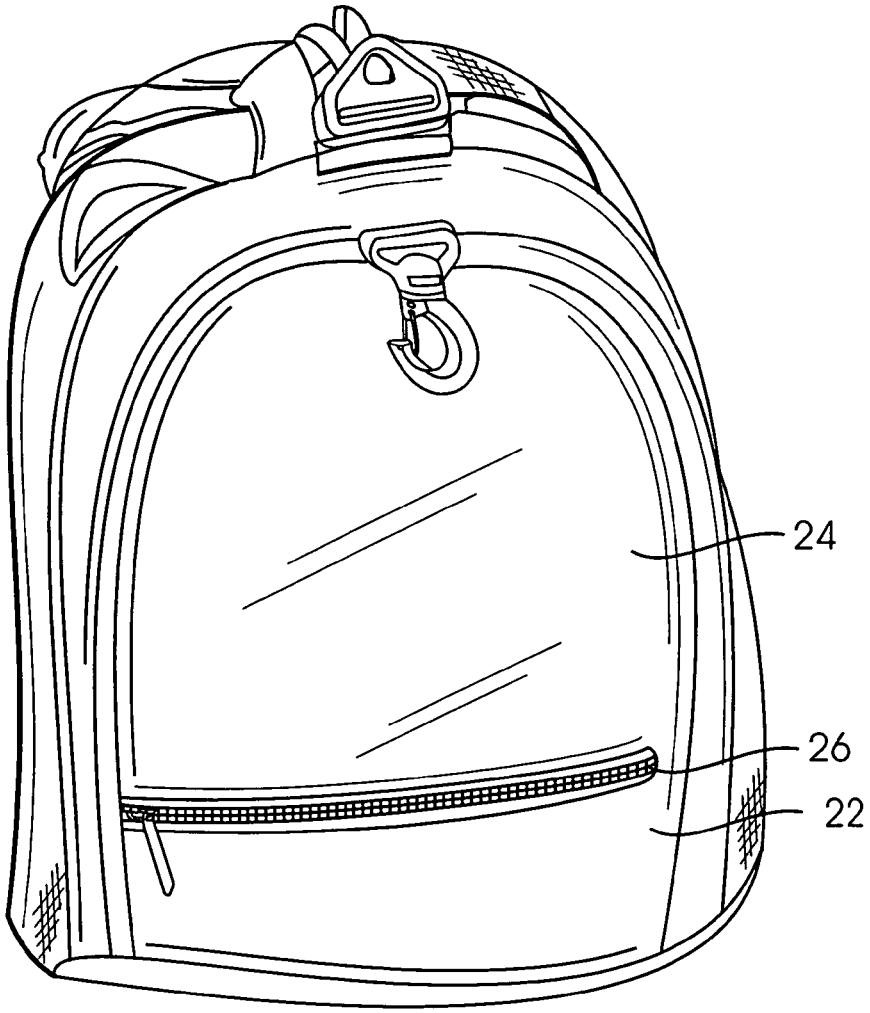
FIG. 2 is a side elevational view of a gym bag incorporating the present invention expansion retainer within a side pocket which is shown in the closed condition.
Figure 3:
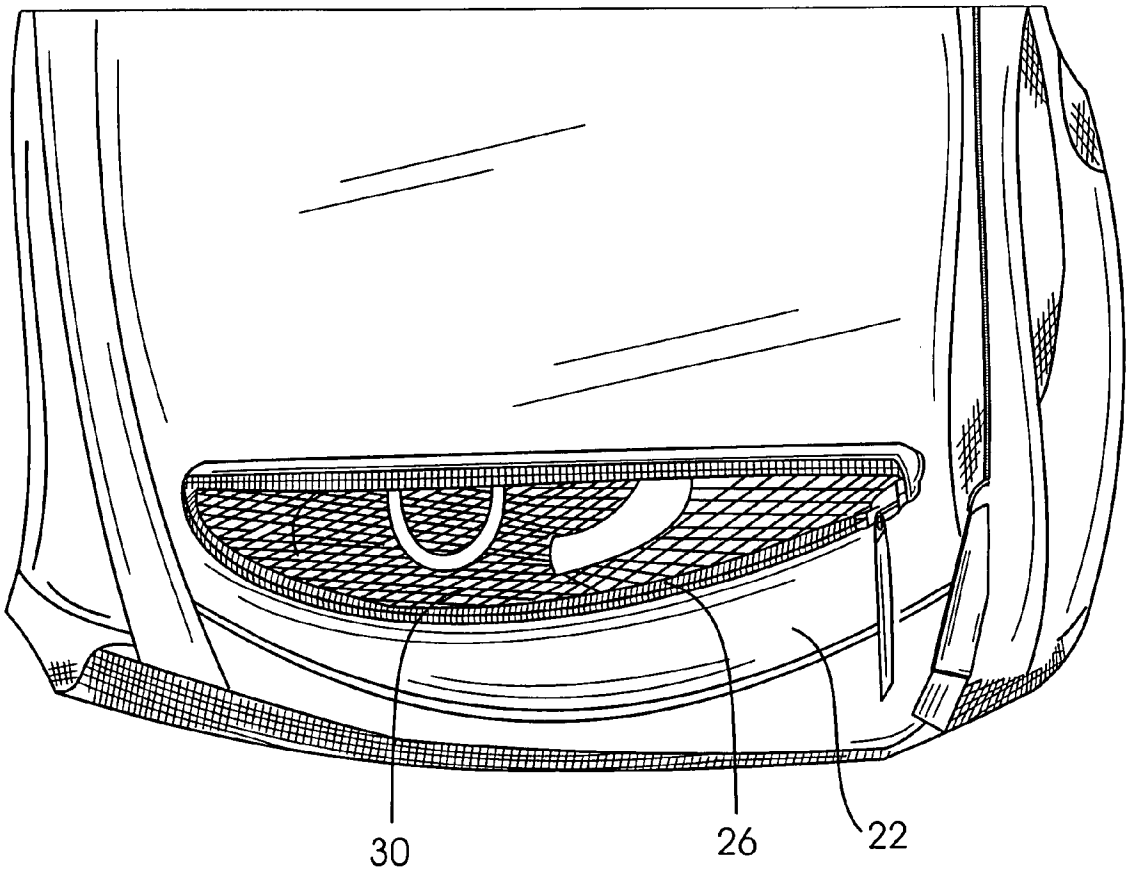
FIG. 3 is a partial side view of the gym bag with the zippered pocket in the opened condition to expose the expansion retainer contained therein.
Figure 4:
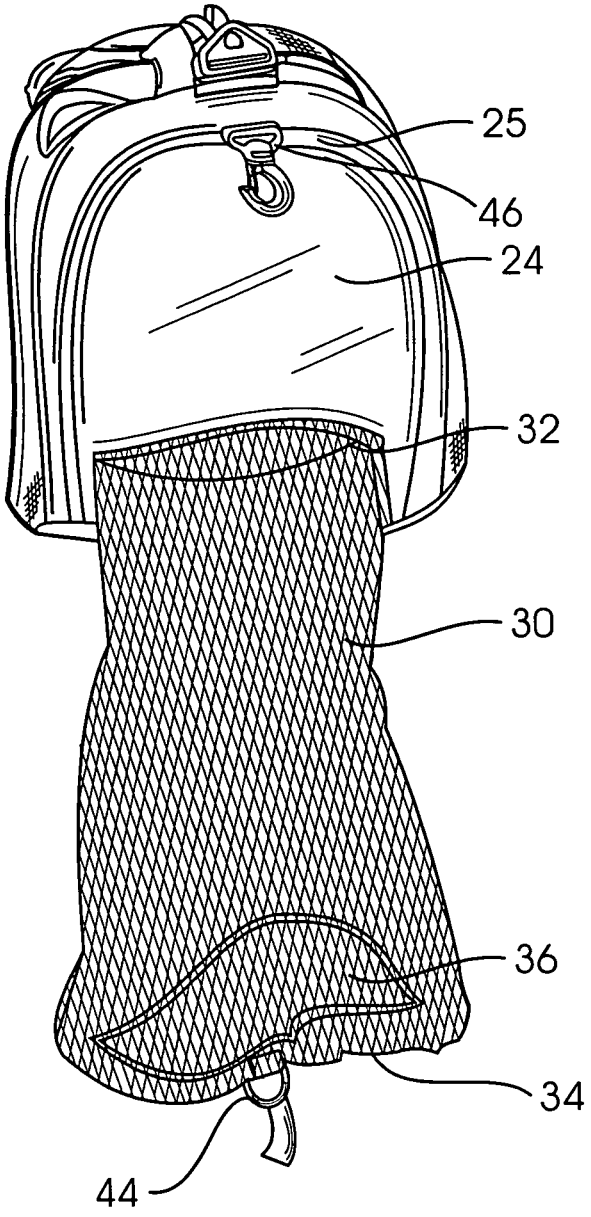
FIG. 4 is a side view of the gym bag with the expansion retainer removed from the zippered pocket and extending away from the side of the gym bag, with the expansion retainer viewed from the back.
Figure 5:
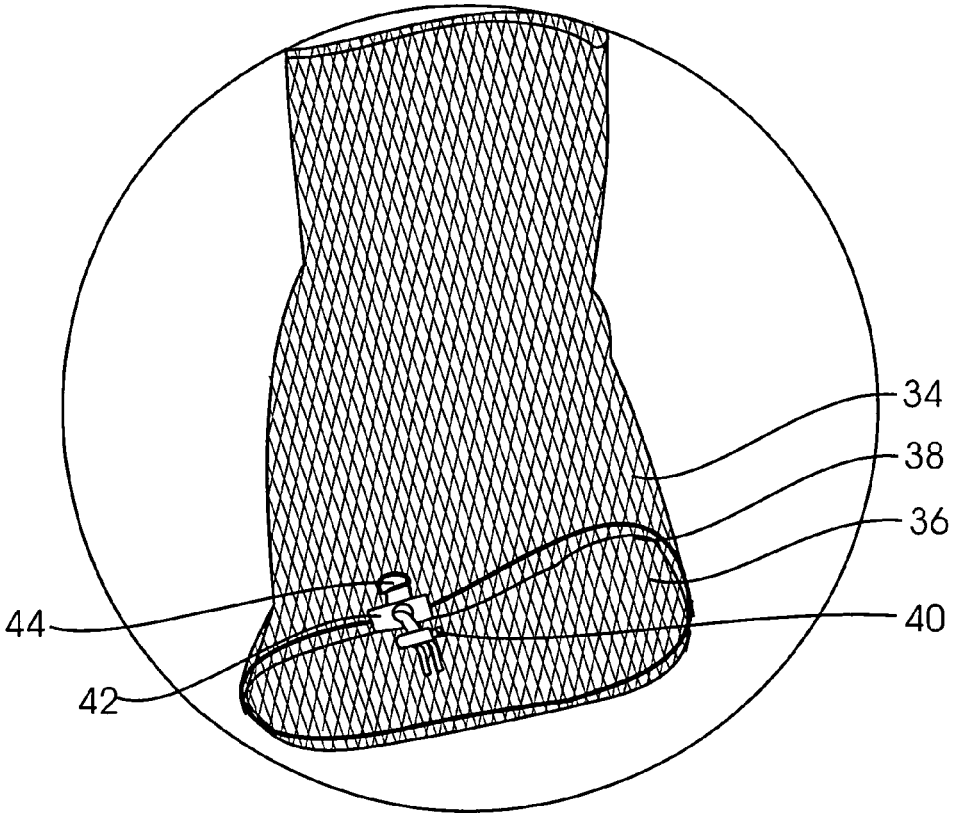
FIG. 5 is an enlarged view of the expansion retainer, illustrating the drawstring and locking retainer, and also illustrating a mating ring adjacent the top of the expansion retainer.
Figure 6:
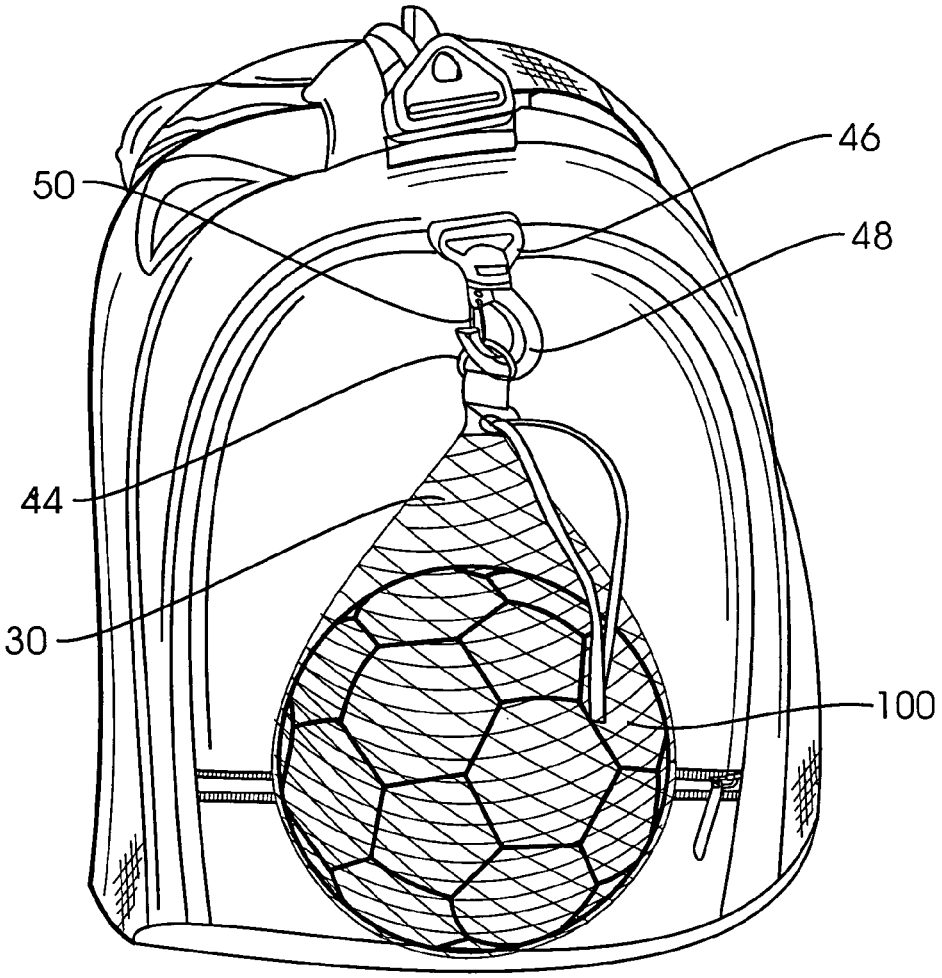
FIG. 6 is an end view of the gym bag with a soccer ball retained in the expansion retainer and the top of the expansion retainer in the closed condition with the top of the expansion retainer fastened to a portion of the gym bag by mating fasteners.
Figure 7:
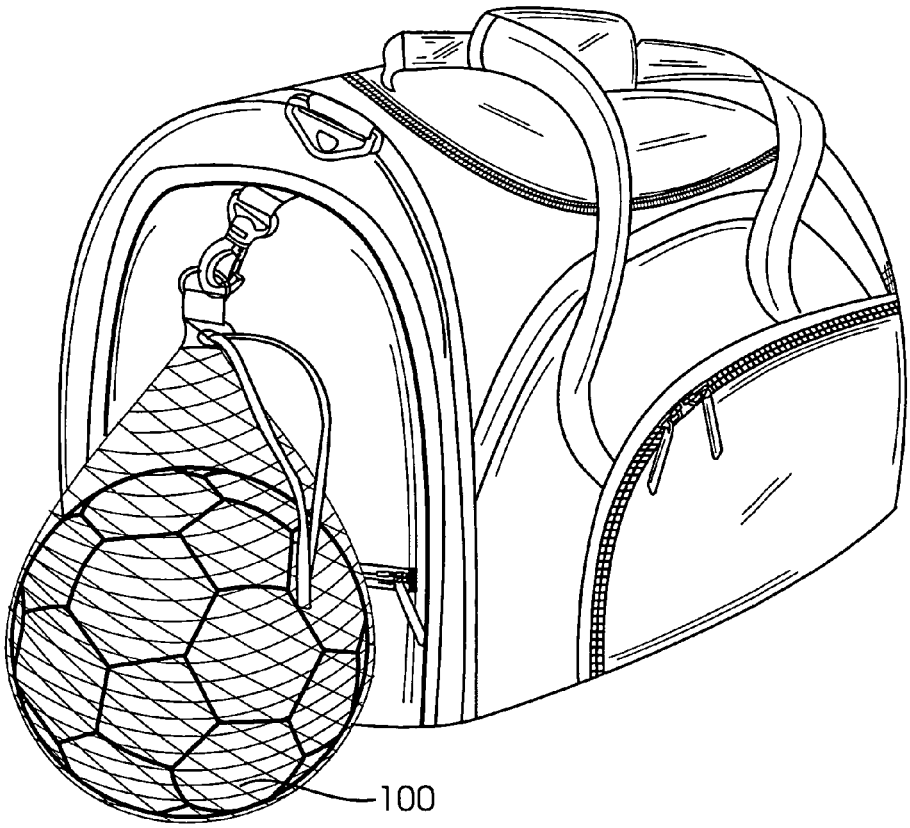
FIG. 7 is a perspective view of the gym bag with a soccer ball retained in the expansion retainer and the top of the expansion retainer in the closed condition with the top of the expansion retainer fastened to a portion of the gym bag by mating fasteners and illustrating how the retained ball and expansion retainer hangs off the side of the gym bag.

Referring to FIGS. 1 through 7, there is illustrated at 10 a gym bag having a body 12 which surrounds an inner compartment into which objects are placed. The gym bag 10 is carried by a pair of straps or handles 14 and 16. Access to the inner compartment is gained by opening and closing means such as a zipper 18. The gym bag can have a multiplicity of exterior pockets such as side pocket 20 and a lower end pocket 22. Lower end pocket 22 is formed into end wall 24 of the body 12 of gym bag 10. Lower pocket 22 is closed by closing means 26 which by way of example is a zipper. Referring to FIG. 3, the lower pocket 22 is shown in the opened condition to expose the present invention expansion retainer 30. Referring to FIG. 4, the expansion retainer is shown in the fully extended condition away from lower end pocket 22. In the preferred embodiment, the expansion retainer is made of nylon mesh. In the preferred embodiment, the expansion retainer 30 is permanently affixed at it's bottom 32 end to the interior of lower end pocket 22 by means such as stitching. Alternatively, it is also within the spirit and scope of the present invention for the expansion retainer 30 to be removably affixed to the interior of the lower end pocket 22 by means such as mating hook and loop fasteners. The top 34 of the expansion retainer 30 has a opening 36 through which objects can be inserted into the expansion retainer 30. The top opening 36 is closed by closing means such as a drawstring 38 and has a locking member 40 on the drawstring to assure that the expansion retainer 30 is tightly closed after an object has been inserted into it. Affixed to the expansion retainer 30 adjacent its top 34 is a tab 42 supporting one mating fastening means 44 which by way of example can be a portion of a ring. Affixed at a remote location on the end wall 24 of gym bag 10 and spaced apart from the lower end pocket 22 is a second mating fastening means 46 which by way of example is a D-clip having a hook portion 48 and a closing member 50. As illustrated in FIGS. 4, 6 and 7, the second mating member 46 is preferably adjacent the top 25 of end wall 24 of gym bag 10. As a result, the combination of the closing means 38 and locking member 40 combined with the two mating members 44 and 46 assures that an object retained within the expansion retainer 30 will be securely retained and will not fall out and further as illustrated in FIG. 7 will permit the expansion retainer 30 and the retained object to hang off the end of the gym bag so as to reduce the strain on a person's back when the gym bag 10 is carried. The retained object as illustrated in FIGS. 6 and 7 is a soccer ball. Other larger objects such as a basketball or football can also be retained within the expansion retainer 30. In addition, wet clothes can be retained in the expansion retainer. By being made out of expandable material such as mesh fabric, the expansion retainer 30 permits the retained object to be seen and also enables the expansion retainer to expand to accommodate the size of the object retained therein. If wet clothes are retained, then the mesh enables water to drip out and allows the wet clothes to dry more rapidly.

Figure 8:
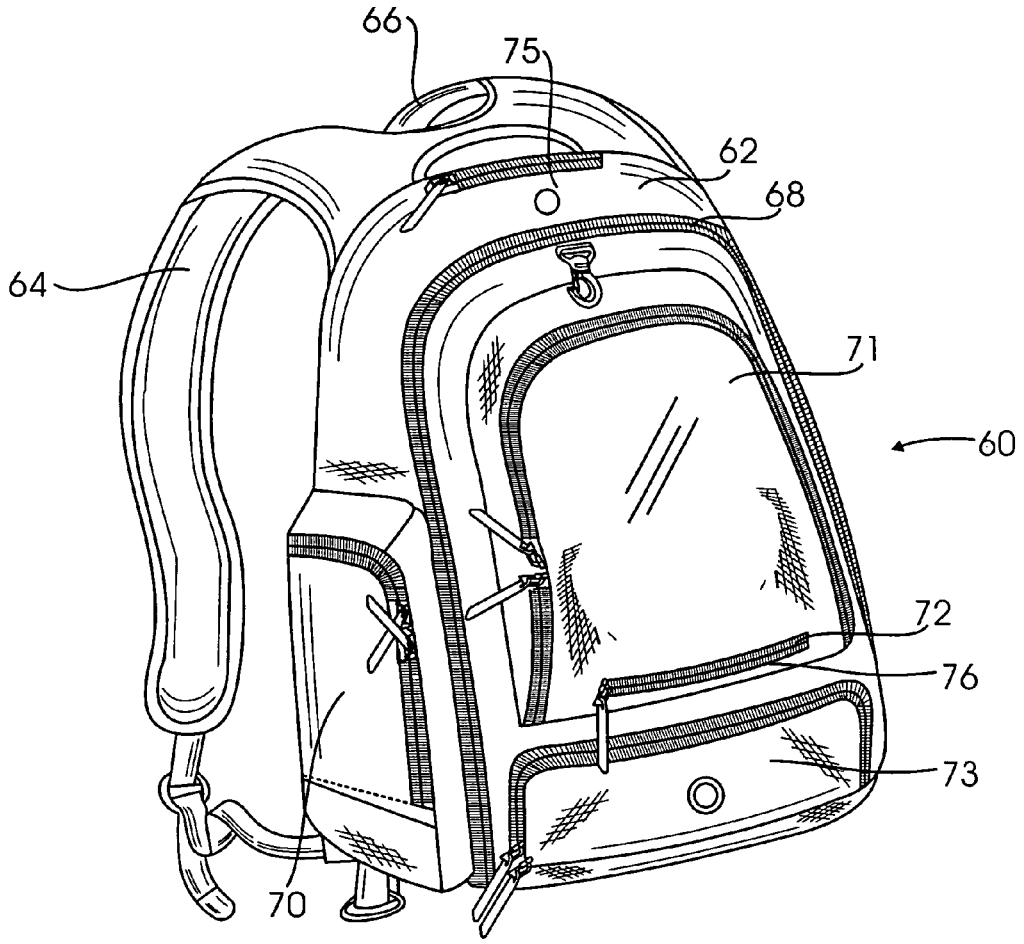
FIG. 8 is a perspective view of a backpack incorporating the present invention expansion retainer with a lower back pocket which is shown in the closed condition.
Figure 9:
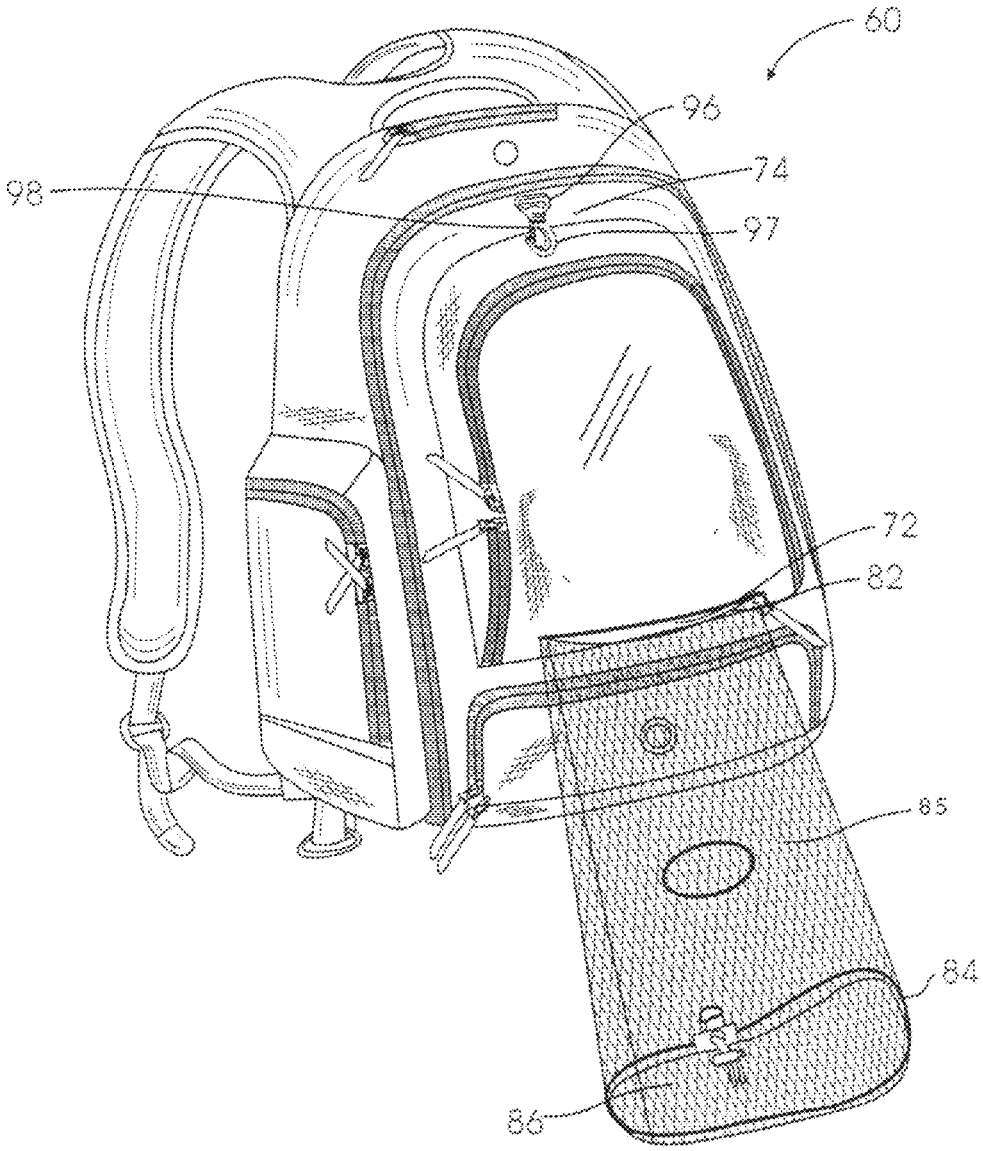
FIG. 9 is a perspective view of a backpack with the lower back pocket in the opened condition and the expansion retainer removed from the lower back pocket and fully extended away from the backpack.
Figure 10:
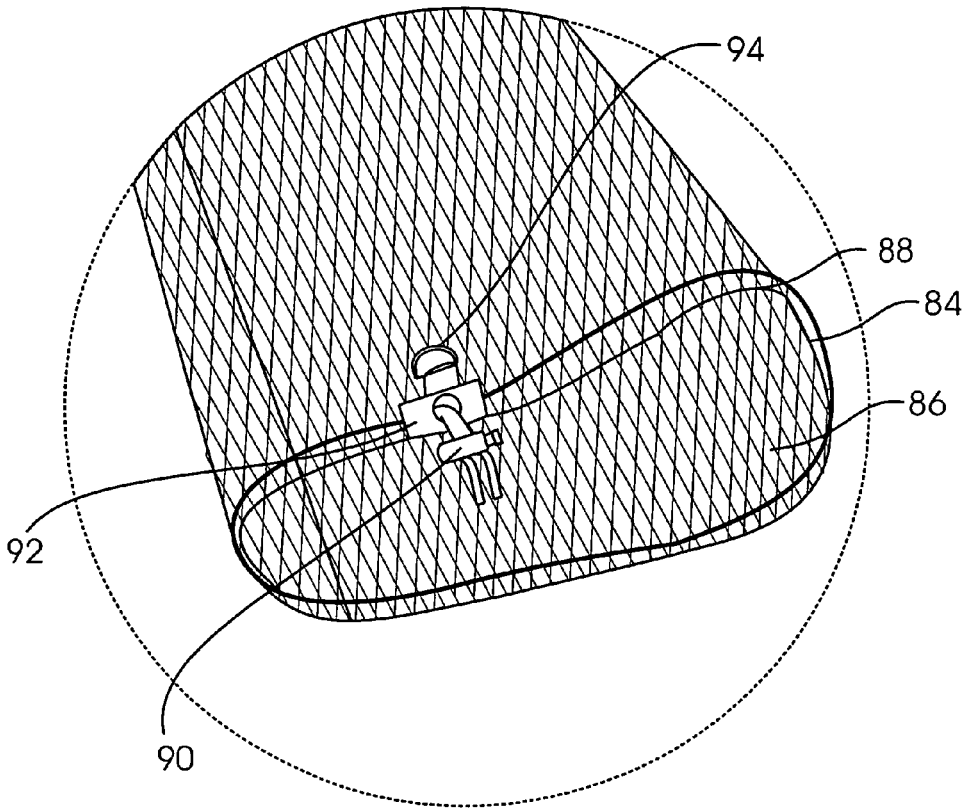
FIG. 10 is an enlarged view of the end of the expansion retainer, illustrating the drawstring and the locking retainer assembly, and also illustrating a locking tab and a mating ring.
Figure 11:
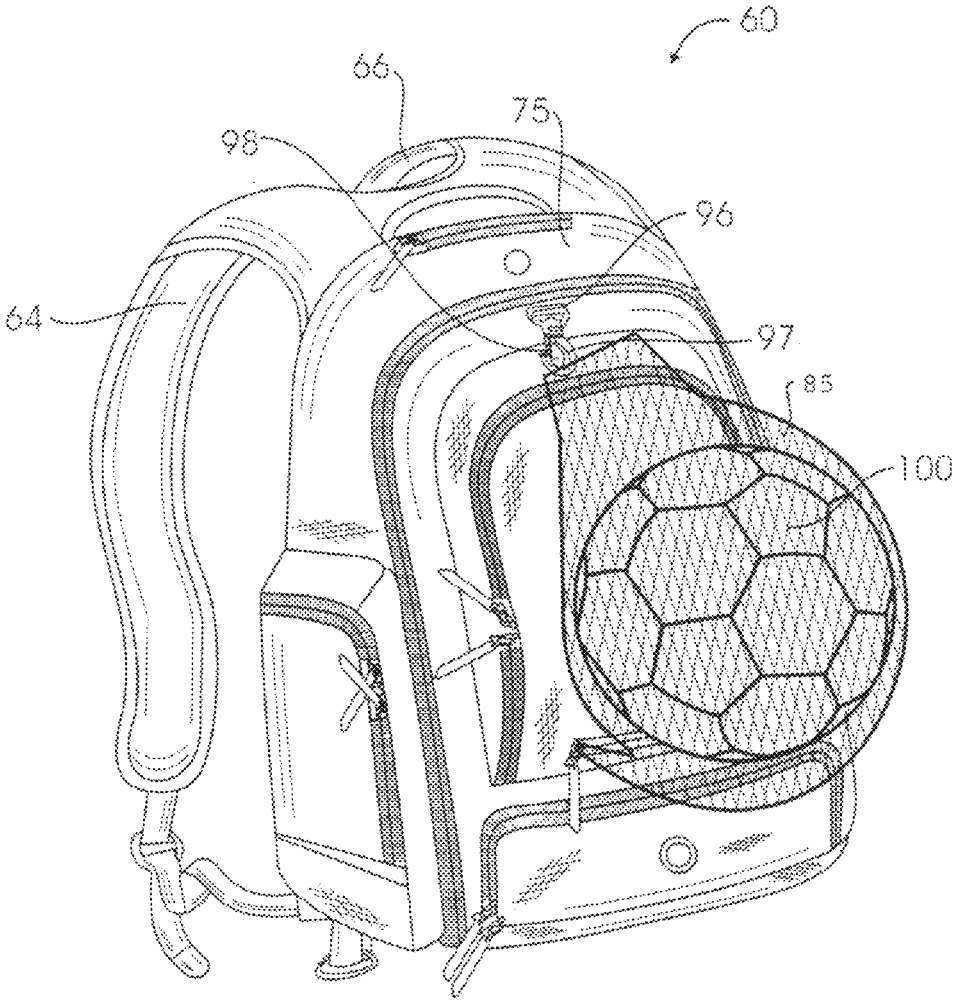
FIG. 11 is a perspective view of the backpack with a soccer ball retained in the expansion retainer and the top of the expansion retainer in the closed condition with the top of the expansion retainer fastened to an upper portion of the backpack by mating fasteners and illustrating how the retained ball and expansion retainer hangs off the back of the backpack.

The present invention expansion retainer can also be incorporated in a backpack. Referring to FIGS. 8 through 11, there is illustrated at 60 a backpack having a body 62 which surrounds an inner compartment into which objects are placed. The backpack 60 is carried by a pair of shoulder straps 64 and 66. Access to the inner compartment is gained by opening and closing means such as a zipper 68. The backpack can have a multiplicity of exterior pockets such as side pocket 70 and a first back pocket 71 which houses a second lower back pocket 72. It also within the spirit and scope of the present invention to have the second lower back pocket 72 be a separate lower pocket such as 73. Back pockets 71 and 73 are formed into back wall 74 of backpack 60. Lower back pocket 72 is closed by closing means 76 which by way of example is a zipper. Referring to FIG. 9, the lower back pocket 72 is shown in the opened condition to expose the present invention expansion retainer 80 which is shown in the fully extended condition away from lower back pocket 72. In the preferred embodiment, the expansion retainer 80 is made of nylon mesh. In the preferred embodiment, the expansion retainer 80 having a body 85 is permanently affixed at it's bottom 82 end to the interior of lower back pocket 72 by means such as stitching. Alternatively, it is also within the spirit and scope of the present invention for the expansion retainer 80 to be removably affixed to the interior of the lower end pocket 72 by means such as mating hook and loop fasteners. Referring to FIGS. 9 and 10, the top 84 of the expansion retainer 80 has an opening 86 through which objects can be inserted into the expansion retainer 80. The top opening 86 is closed by closing means such as a drawing 88 and has a locking member 90 to assure that the expansion retainer 80 is tightly closed after an object has been inserted into it. Affixed to the expansion retainer 80 adjacent its top 84 is a tab 92 supporting one mating fastening means 94 which by way of example can be a portion of a ring. Affixed at a remote location on the back wall 74 of backpack 60 and spaced apart from the lower back pocket 72 is a second mating fastening means 96 which by way of example is a D-clip having a hook portion 97 and a closing member 98. As illustrated in FIGS. 8, 9 and 10, the second mating member 96 is preferably adjacent the top 75 of back wall 74 of backpack 60. As a result, the combination of the closing means 88 and locking member 90 combined with the two mating members 94 and 96 assures that an object retained within the expansion retainer 30 will be securely retained and will not fall out and further as illustrated in FIG. 11 will permit the expansion retainer 80 and the retained object to hang off the back of the backpack 60 so as to reduce the strain on a person's back when the backpack 60 is carried. The retained object as illustrated in FIG. 11 is a soccer ball. Other larger objects such as a basketball or football can also be retained within the body of the expansion retainer 80. In addition, wet clothes can be retained in the expansion retainer. By being made out of expandable material such as mesh fabric, the expansion retainer permits 30 the retained object to be seen and also enables the expansion retainer to expand to accommodate the size of the object retained therein. If wet clothes are retained, then the mesh enables water to drip out and allows the wet clothes to dry more rapidly.

The gym bag 10 has been illustrated with the pocket 22 retaining the expansion retainer 30 supported on an end wall 24 of the gym bag 10 while the backpack 60 has been illustrated with the pocket 72 retaining the expansion retainer 80 supported on a first pocket 71 which in turn is supported on the back wall 74 of the backpack 60. It is also within the spirit and scope of the present invention to have a reverse embodiment. A gym bag can have a first larger pocket on its end wall with the pocket housing the expansion retainer supported within the first larger pocket, as illustrated with the backpack. Similarly, a backpack can have the pocket housing the expansion retainer directly supported on the back wall of the backpack, such as pocket 73.

Defined in detail, the present invention is a carrying bag having a body surrounding an interior compartment and means by which the carrying bag is carried, the body having at least one wall to which at least one pocket is affixed, the at least one pocket having an interior compartment and is opened and closed by closing means, the present invention comprising: an expansion retainer having a bottom end and a top end and made of expandable material, the expansion retainer affixed within the interior compartment of the at least one pocket and retained therein when not in use, and when the at least one pocket is open, the expansion retainer can be caused to extend outwardly from the at least one pocket, the top of the expansion retainer having an opening through which objects can be placed into the expansion retainer, the expansion retainer having closing means including locking means adjacent its top end by which the opening can be closed and locked closed to retain an object therein, a first mating fastening means adjacent the top of the expansion retainer and a second mating fastening means at a location on the carrying bag which is remote from the location of the at least one pocket, the two mating fastening means being fastened together to assure that the retained object will not fall out and to permit the retained object and expansion retainer to hang off a side of the carrying bag so as not to put a strain on the back of a person who is carrying the carrying bag.

Defined more broadly, the present invention is a carrying bag having a body means by which the carrying bag is carried, the body having at least one wall to which at least one pocket is affixed, the at least one pocket having an interior compartment and an opening, the present invention comprising: an expansion retainer having a bottom end and a top end and made of expandable material, the expansion retainer affixed within the interior compartment of the at least one pocket and retained therein when not in use, and the expansion retainer can be caused to extend outwardly from the at least one pocket through the opening in the at least one pocket, the top end of the expansion retainer having an opening through which objects can be placed into the expansion retainer, the expansion retainer having closing means adjacent its top by which the opening can be closed to retain an object therein, a first mating fastening means adjacent the top of the expansion retainer and a second mating fastening means at a location on the carrying bag which is remote from the location of the at least one pocket, the two mating fastening means being fastened together to assure that the retained object will not fall out and to permit the retained object and expansion retainer to hang off a side of the carrying bag so as not to put a strain on the back of a person who is carrying the carrying bag.

Defined alternatively in detail, the present invention is a carrying bag having a body surrounding an interior compartment and means by which the carrying bag is carried, the body having at least one wall to which a first pocket is affixed, the first pocket having an exterior wall and an interior compartment which receives a second pocket, the second pocket having an interior compartment and is opened and closed by closing means on the wall of the first pocket, the present invention comprising: an expansion retainer having a bottom end and a top end and made of expandable material, the expansion retainer affixed within the interior compartment of the second pocket and retained therein when not in use, and when the second pocket is open, the expansion retainer can be caused to extend outwardly from the second pocket, the top of the expansion retainer having an opening through which objects can be placed into the expansion retainer, the expansion retainer having closing means including locking means adjacent its top end by which the opening can be closed and locked closed to retain an object therein, a first mating fastening means adjacent the top of the expansion retainer and a second mating fastening means at a location on the carrying bag which is remote from the location of the second pocket, the two mating fastening means being fastened together to assure that the retained object will not fall out and to permit the retained object and expansion retainer to hang off a side of the carrying bag so as not to put a strain on the back of a person who is carrying the carrying bag.

Defined alternatively and more broadly, the present invention is a carrying bag having a body and means by which the carrying bag is carried, the body having at least one wall to which a first pocket is affixed, the first pocket having an exterior wall and an interior compartment which receives a second pocket, the second pocket having an interior compartment and an opening in the wall of the first pocket, the present invention comprising: an expansion retainer having a bottom end and a top end and made of expandable material, the expansion retainer affixed within the interior compartment of the second pocket and retained therein when not in use, and the expansion retainer can be caused to extend outwardly from the opening in the second pocket, the top of the expansion retainer having an opening through which objects can be placed into the expansion retainer, the expansion retainer having closing means adjacent its top end by which the opening can be closed to retain an object therein, a first mating fastening means adjacent the top of the expansion retainer and a second mating fastening means at a location on the carrying bag which is remote from the location of the second pocket, the two mating fastening means being fastened together to assure that the retained object will not fall out and to permit the retained object and expansion retainer to hang off a side of the carrying bag so as not to put a strain on the back of a person who is carrying the carrying bag.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A carrying bag comprising:

a. a body of the carrying bag surrounding an interior compartment and means by which the carrying bag is carried, the body having at least one wall to which at least one pocket is affixed, the at least one pocket having an interior compartment and is opened and closed by closing means;

b. an expansion retainer having a bottom end and a top end and made of expandable material, the bottom end of the expansion retainer affixed within the interior compartment of the at least one pocket and the expansion retainer retained therein when not in use, and when the at least one pocket is open, the expansion retainer including the top end and a body can be caused to extend outwardly from the at least one pocket, the top of the expansion retainer having an opening through which objects can be placed into the expansion retainer, the expansion retainer having closing means including locking means adjacent its top end by which the opening can be closed and locked to retain an object therein;

c. a first mating fastening means positioned adjacent the top of the expansion retainer and a second mating fastening means positioned at a location on the carrying bag which is remote from the location of the at least one pocket, the two mating fastening means being fastened together in addition to the top end of the expansion retainer that is closed to assure that the retained object will not fall out and to permit the body of the expansion retainer having the retained object anti to movably hang off a side of the carrying bag;

d. the carrying bag is a backpack having a back wall and the at least one pocket is located on the back wall such that the expansion retainer and object retained therein hangs off the end of the backpack when it is being carried to thereby reduce the strain on the back of a person carrying the backpack;

e. said expansion retainer is made of nylon mesh;

f. said closing means is a drawstring which is tightened closed by a locking member;

g. said first mating fastening means is a portion of a ring having an opening extending through it and said second mating fastening means is a D-clip having a hook portion and a closing member, the hook portion receiving the opening in the first mating fastening means and the closing means retaining the portion of a ring within the hook portion; and h. the expansion retainer retains objects which are either too large to fit within the backpack or not desirable to be retained within the backpack.

2. The carrying bag in accordance with claim 1 wherein the expansion retainer is permanently affixed adjacent the bottom of the expansion retainer within the compartment of said at least one pocket.

3. The carrying bag in accordance with claim 1 wherein the expansion retainer is removably affixed adjacent the bottom of the expansion retainer within the compartment of said at least one pocket.

4. A carrying bag comprising:

a. a body means of the carrying bag by which the carrying bag is carried, the body means having at least one wall to which at least one pocket is affixed, the at least one pocket having an interior compartment and an opening;

b. an expansion retainer having a bottom end and a top end and made of expandable material, the bottom end of the expansion retainer affixed within the interior compartment of the at least one pocket and retained therein when not in use, and the expansion retainer including the top and a body can be caused to extend outwardly from the at least one pocket through the opening in the at least one pocket, the top end of the expansion retainer having an opening through which objects can be placed into the expansion retainer, the expansion retainer having closing means adjacent its top by which the opening can be closed to retain an object therein;

c. a first mating fastening means adjacent the top of the expansion retainer and a second mating fastening means at a location on the carrying bag which is remote from the location of the at least one pocket, the two mating fastening means being fastened together in addition to the top of the expansion container that is closed to assure that the retained object will not fall out and to permit the body of the expansion retainer having the retained object to movably hang off a side of the carrying bag;

d. the carrying bag is a backpack having a back wall and the at least one pocket is located on the back wall such that the expansion retainer and object retained therein hangs off the end of the backpack when it is being carried to thereby reduce the strain on the back of a person carrying the backpack;

e. said expansion retainer is made of nylon mesh;

f. said closing means is a drawstring which can be tightened;

g. said first mating fastening means is a portion of a ring having an opening extending through it and said second mating fastening means is a D-clip having a hook portion and a closing member, the hook portion receiving the opening in the first mating fastening means and the closing means retaining the portion of a ring within the hook portion; and h. the expansion retainer retains objects which are either too large to fit within the backpack or not desirable to be retained within the backpack.

5. The carrying bag in accordance with claim 4 wherein the expansion retainer is permanently affixed adjacent the bottom of the expansion retainer within the compartment of said at least one pocket.

6. The carrying bag in accordance with claim 4 wherein the expansion retainer is removably affixed adjacent the bottom of the expansion retainer within the compartment of said at least one pocket.

7. A carrying bag comprising:

a. a body of the carrying bag surrounding an interior compartment and means by which the carrying bag is carried, the body having at least one wall to which a first pocket is affixed, the first pocket having an exterior wall and an interior compartment which receives a second pocket, the second pocket having an interior compartment and is opened and closed by closing means on the wall of the first pocket;

b. an expansion retainer having a bottom end and a top end and made of expandable material, the bottom end of the expansion retainer affixed within the interior compartment of the second pocket and retained therein when not in use, and when the second pocket is open, the expansion retainer including the top end and a body can be caused to extend outwardly from the second pocket, the top of the expansion retainer having an opening through which objects can be placed into the expansion retainer, the expansion retainer having closing means including locking means adjacent its top end by which the opening can be closed and locked closed to retain an object therein; and c. a first mating fastening means positioned adjacent the top of the expansion retainer and a second mating fastening means positioned at a location on the carrying bag which is remote from the location of the second pocket, the two mating fastening means being fastened together in addition to the top end that is closed to assure that the retained object will not fall out and to permit the body of the expansion retainer having the retained object to movably hang off a side of the carrying bag.

8. The carrying bag in accordance with claim 7 wherein the expansion retainer is permanently affixed adjacent the bottom of the expansion retainer within the compartment of said second pocket.

9. The carrying bag in accordance with claim 7 wherein the expansion retainer is removably affixed adjacent the bottom of the expansion retainer within the compartment of said second pocket.

10. A carrying bag comprising:

a. a body of the carrying bag and means by which the carrying bag is carried, the body having at least one wall to which a first pocket is affixed, the first pocket having an exterior wall and an interior compartment which receives a second pocket, the second pocket having an interior compartment and an opening in the wall of the first pocket;

b. an expansion retainer having a bottom end and a top end and made of expandable material, the bottom end of the expansion retainer affixed within the interior compartment of the second pocket and retained therein when not in use, and the expansion retainer including the top end and a body can be caused to extend outwardly from the opening in the second pocket, the top of the expansion retainer having an opening through which objects can be placed into the expansion retainer, the expansion retainer having closing means adjacent its top end by which the opening can be closed to retain an object therein; and c. a first mating fastening means adjacent the top of the expansion retainer and a second mating fastening means at a location on the carrying bag which is remote from the location of the second pocket, the two mating fastening means being fastened together in addition to the top end that is closed to assure that the retained object will not fall out and to permit the body of the expansion retainer having the retained object to movably hang off a side of the carrying bag.

11. The carrying bag in accordance with claim 10 wherein the expansion retainer is permanently affixed adjacent the bottom of the expansion retainer within the compartment of said second pocket.

12. The carrying bag in accordance with claim 10 wherein the expansion retainer is removably affixed adjacent the bottom of the expansion retainer within the compartment of said second pocket.

13. The carrying bag in accordance with claim 7, further comprising:

a. the carrying bag is a backpack having a back wall and the first pocket is located on the back wall such that the expansion retainer and object retained within the second pocket hangs off the end of the backpack when it is being carried to thereby reduce the strain on the back of a person carrying the backpack;

b. said expansion retainer is made of nylon mesh;

c. said closing means is a drawstring which is tightened closed by a locking member;

d. said first mating fastening means is a portion of a ring having an opening extending through it and said second mating fastening means is a D-clip having a hook portion and a closing member, the hook portion receiving the opening in the first mating fastening means and the closing means retaining the portion of a ring within the hook portion; and e. the expansion retainer retains objects which are either too large to fit within the backpack or not desirable to be retained within the backpack.

14. The carrying bag in accordance with claim 10, further comprising:

a. the carrying bag is a backpack having a back wall and the first pocket is located on the back wall such that the expansion retainer and object retained within the second pocket hangs off the end of the backpack when it is being carried to thereby reduce the strain on the back of a person carrying the backpack;

b. said expansion retainer is made of nylon mesh;

c. said closing means is a drawstring which can be tightened;

d. said first mating fastening means is a portion of a ring having an opening extending through it and said second mating fastening means is a D-clip having a hook portion and a closing member, the hook portion receiving the opening in the first mating fastening means and the closing means retaining the portion of a ring within the hook portion; and e. the expansion retainer retains objects which are either too large to fit within the backpack or not desirable to be retained within the backpack.

* * * * *